US006537031B1

(12) United States Patent
Bacskay

(10) Patent No.: US 6,537,031 B1
(45) Date of Patent: Mar. 25, 2003

(54) MARINE PROPELLER WITH DETACHABLE BLADES

(75) Inventor: Istvan Bacskay, Kristinehamn (SE)

(73) Assignee: Rolls-Royce AB, Kristinehamn (SE)

( * ) Notice: Subject to any disclaimer, the term of this patent is extended or adjusted under 35 U.S.C. 154(b) by 0 days.

(21) Appl. No.: 09/979,102

(22) PCT Filed: May 12, 2000

(86) PCT No.: PCT/SE00/00951

§ 371 (c)(1),
(2), (4) Date: Nov. 19, 2001

(87) PCT Pub. No.: WO00/69719

PCT Pub. Date: Nov. 23, 2000

(30) Foreign Application Priority Data

May 19, 1999 (SE) ..... 9901821

(51) Int. Cl.[7] ..... F04D 29/36
(52) U.S. Cl. ..... 416/207; 416/219 R; 416/244 R
(58) Field of Search ..... 416/207, 219 R, 416/220 R, 219 A, 244 R, 204 R

(56) References Cited

U.S. PATENT DOCUMENTS 3,554,664 A * 1/1971 Cheeseman et al.
4,260,332 A * 4/1981 Weingart et al. ..... 416/226
4,407,635 A * 10/1983 Grimes et al. ..... 416/230
4,915,590 A * 4/1990 Eckland et al. ..... 416/225
5,458,465 A * 10/1995 von Wieser et al. .... 416/214 R
6,305,905 B1 * 10/2001 Nagle et al. ..... 416/204 R
6,371,730 B1 * 4/2002 Wobben ..... 416/244 R

FOREIGN PATENT DOCUMENTS

DE 483 317 10/1929
GB 1 455 504 11/1976

OTHER PUBLICATIONS

Company Publication "KaMeWa ABP (Adjustable Built–Up Propeller)", 1974, Sweden, Karlstads Mekaniska Werkstad.
Commercial Publication showing the SUPERBOLT® product, Carnegie, Pennsylvania: Superbolt, Feb. 1997.

* cited by examiner

*Primary Examiner*—Edward K. Look
*Assistant Examiner*—James M McAleenan
(74) *Attorney, Agent, or Firm*—Browdy and Neimark

(57) ABSTRACT

A marine propeller comprises a hollow hub body (11), a plurality of propeller blades (16) and a plurality of fastening devices (19, 21) for each propeller blade (16). Each fastening device includes a tension rod (19) and a flange member (22) mounted on the tension rod. The propeller blades (16) may be turnable for adjustment of the blade pitch angle ($\alpha$) and lockable in a selected position by means of the fastening devices (19, 21). The flange member (22) has a plurality of recesses (23) and tensioning members (24) received in the recesses. These tensioning members (24) are extendable from the flange member (22) towards the hub body wall (14) to apply tension to the tension rod (19).

9 Claims, 2 Drawing Sheets

MARINE PROPELLER WITH DETACHABLE BLADES

REFERENCE TO RELATED APPLICATIONS

The present application is the national stage under 35 U.S.C. 371 of international application PCT/SE00/00951, filed May 12, 2000, which designated the United States, and which international application was published under PCT Article 21(2) in the English language.

This invention relates to a built-up marine propeller, i.e. a marine propeller the blades of which are detachably secured to a hub body. More particularly, the invention relates to a built-up marine propeller having a hollow hub body and a plurality of propeller blades distributed about the hub body and detachably secured to it in engagement with an external bearing surface on a wall of the hub body.

Although not so limited, the invention is particularly useful in a built-up propeller having adjustable blades, i.e. a propeller the blades of which can be moved to a selected pitch position on the hub body and locked in that position.

In such a propeller the blade pitch is fixed in the sense that it cannot be changed when the propeller is rotating. However, when the propeller is stationary, it is possible to change the pitch within a certain relatively narrow range.

A need for such a small change of the pitch of a marine propeller may occur from time to time as a consequence of changed operating conditions of the ship equipped with the propeller, e.g. in connection with a change from summer operation to winter operation or operation at a changed maximum or cruising speed.

Patent specifications GB-1 455 504 and DE-483 317 and a company publication KaMeWa ABP (Adjustable Built-Up Propeller) published in 1974 by Karlstads Mekaniska Werkstad (Sweden), show some examples of prior art embodiments of built-up marine propellers with detachable blades, each blade being secured to the hub body by a plurality of bolts. In these prior art propellers, the propeller blades are locked to the hub body by means of a number of fastening devices. Each fastening device includes a tension rod in the form of a threaded bolt extending through holes formed in the hub body and in the blade flanges by which the blades are seated on a bearing surface of the hub body.

In the propellers shown in GB-1 455 504, the bolts are stud bolts passed from inside the hub body into threaded blind holes in the blade flanges and tightened by nuts screwed onto the inner ends of the stud bolts. Dowels are used to locate the blades in a precise pitch position relative to the hub body. There is no provision for adjusting the pitch.

In the propeller shown in DE-483 317, the bolts are headed bolts passed from the outer side, the side of the blade flanges exposed to the water, through elongate holes in the blade flanges into the hub body. Although the purpose of the elongate shape of the holes in the blade flanges is not to make the pitch adjustable, it may nevertheless admit of some adjustment of the pitch.

In the propeller shown in the afore-mentioned company publication, headed bolts are passed from inside the hub body into threaded blind holes in the blade flanges. The holes in the blade flanges and the holes in the hub body are arranged such that a few different predetermined pitch positions can be selected. Dowels are used to locate the blades accurately in the different pitch positions. When a blade is to be adjusted, the bolts are first loosened so that the blade can be turned about its longitudinal axis to a desired position within the range of adjustability. The bolts are then tightened to lock the blade in the selected position.

As will be appreciated, it is very important that the blades are firmly locked in the selected position of adjustment. The force by which the bolts have to clamp the blade flange against the bearing surface, and hence the torque with which the bolts have to be tightened, is therefore substantial. Near the bolts the space available for the application of wrenches or other tightening tools is limited, however, and for this and other reasons it is difficult to apply a torque that is great enough to ensure a satisfactory locking relying only on the friction between the blade flange and the hub body. This is so especially where the bolts are tightened from inside the hub body.

The same problem exists in built-up propellers having non-adjustable blades. Even in such propellers, the fastening devices have to be tightened under a considerable torque.

In the prior art propellers the dowels used to accurately locate the blades relative to the hub body and to prevent undesired changes of the pitch after the adjustment also occupy a certain space, and for that reason only a few fixed pitch positions within the range of adjustment are feasible.

It is desirable to be able to adjust the blades substantially continuously between the limits of the range of adjustment, i.e. to an infinite number of positions of adjustment which can be selected as desired, and to lock the blades reliably in every selected position of adjustment without having to use dowels. Whether or not the propeller is of the type having adjustable blades, it is also desirable to be able to apply the fastening devices from within the hub body with adequate force using tools small enough to permit them to be used inside the hub body.

Accordingly, it is an object of the invention to provide a propeller of the kind indicated initially having these desirable properties.

In accordance with the invention this object is achieved with a propeller having the features set forth in the characterising part of the independent claims. The dependent claims are directed to preferred features of the propeller according to the invention.

As will appear more clearly from the description that follows, each tension rod—which may be the shank of a bolt—may be provided with a flange member, such as a nut or a bolt head, having a plurality of recesses distributed about the tension rod and a like plurality of tensioning members which are received in these recesses and extendable from the flange member towards the wall of the hub body to force the flange member away from the wall of the hub body and thereby subject the tension rod to tension.

Naturally, each tensioning member will apply only a fraction of the total tensioning force that has to be applied to the tension rod to ensure a reliable frictional locking of the propeller blade to the hub body. However, the combined tension force applied by the tensioning members can ensure a firm frictional locking without it being necessary to subject the individual tensioning members to more than a small fraction of the force required for a firm locking of the blades of the prior art propellers, where for each fastener device the torque is applied to a single fastener bolt head or to a nut on the fastener bolt.

Because each tensioning member only has to be subjected to a small force, the tensioning of the tension rod can be effected by means of a small tool, such as a power wrench if the tensioning members are screws. In many cases it is therefore possible to carry out the tensioning operation from within the cavity of the hub body; propellers of the kind with which the invention is concerned normally are large enough to permit a mechanic to work with a hand-held power tool inside the hub body when the propeller blade position is adjusted.

The tension rods in such cases can enter into the propeller blade from the side of the blade flange engaging the bearing surface on the hub body. They accordingly need not extend completely through the thickness of the blade flange, which can therefore have a smooth external surface. This also means that the entire flange surface engaging the bearing surface on the hub body is available for the application of the tension rods. If, on the other hand, the tension rods enter into the blade flange from the opposite side, the side exposed to the water, the root of the propeller blade restricts the space available for the application of the tension rods.

The invention will be more fully understood from the following description of an embodiment shown by way of example in the accompanying drawings, namely a built-up propeller having adjustable blades.

Figure 1:
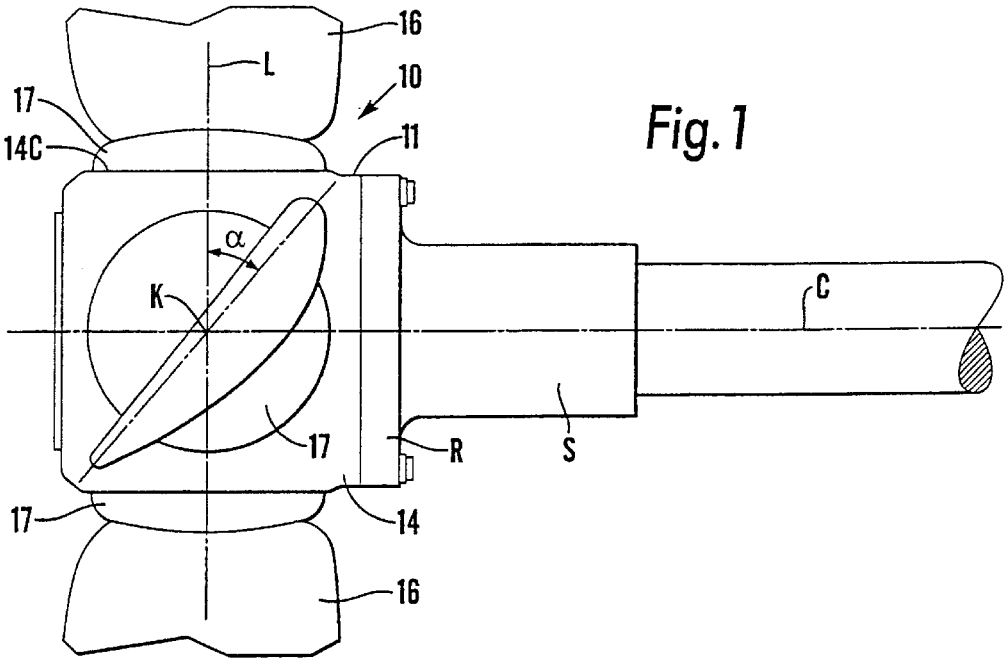
FIG. 1 is a side view of the propeller and a portion of the associated propeller shaft.
Figure 2:
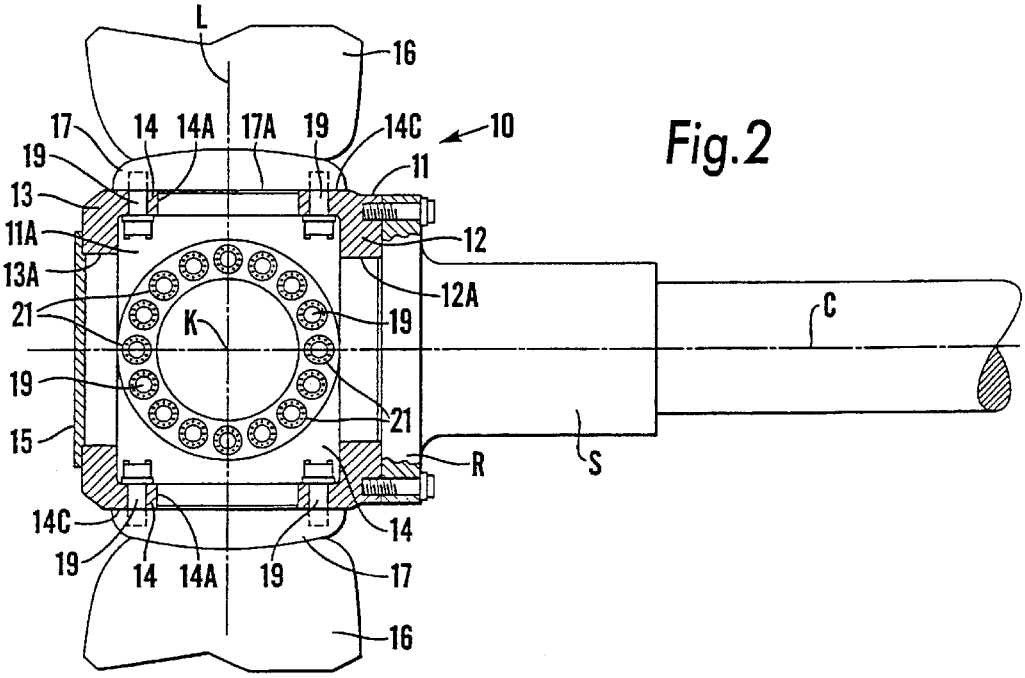
FIG. 2 is a view similar to FIG. 1 but shows the hub body of the propeller sectioned along a plane containing the axis of the propeller shaft.
Figure 3:
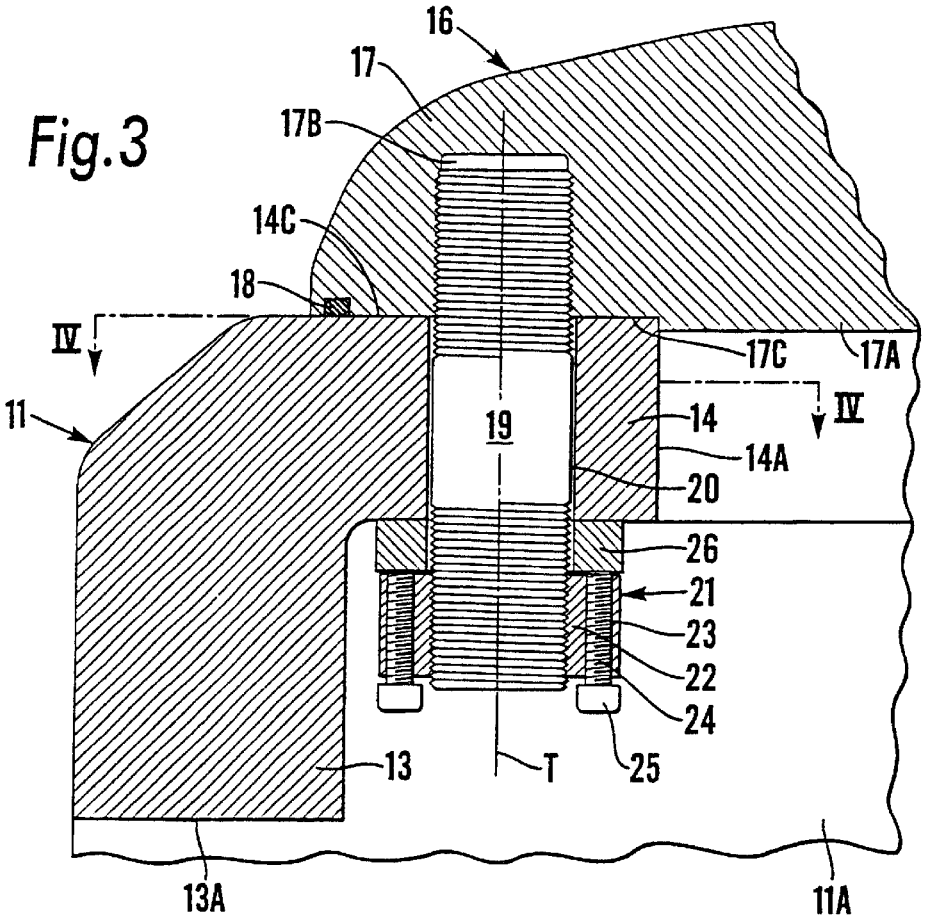
FIG. 3 is an enlarged sectional view of the upper left corner of the hub body as shown in FIG. 2 and the adjacent portion of the propeller blade flange.

The built-up marine propeller 10 shown in the drawings is bolted to a flange R on a propeller shaft S only a part of which is shown and the axis of which is designated by C. The propeller 10 comprises a generally cube-shaped hollow hub body 11 including a front wall 12 by which the hub body is bolted to the propeller shaft flange R, a rear wall 13 and four side walls 14 disposed about the axis C. Three of the four side walls are shown in FIG. 2 while the fourth is shown in FIG. 1.

Circular openings 12A and 13A centred on the axis C of the propeller shaft are formed in the front wall 12 and the back wall 13. Circular openings 14A formed in the side walls 14 are centred on orthogonal axes L (only one of them is shown in the drawings) which intersect each other and the axis C of the propeller shaft at a point K.

Normally, the rear wall opening 13A, through which the cavity 11A of the hub body 11 is accessible, is tightly closed by a detachable cover plate 15.

The outer surface of each side wall 14 forms an external flat bearing surface 14C for a propeller blade 16 secured to the hub body 11 by a circular blade flange 17 centred on the axis L. A circular flat protrusion 17A is formed on the side of the blade flange 17 facing the hub body 11 and projects into the opening 14A of the side wall 14 to centre the blade flange 17 and thus the entire propeller blade 16 relative to the hub body 11. On the same side the blade flange has an annular groove accommodating a sealing ring 18 by which the blade flange is in sealing engagement with the bearing surface 14C.

Each of the four propeller blades 16, which are disposed in cruciform configuration, is held to the hub body 11 by a plurality of, sixteen in the illustrated embodiment, tention rods 19 the form of stud bolts which are evenly spaced apart along an imaginary circular cylindrical surface D centred on the axis L with their axes T contained in that cylindrical surface D and extending parallel to the axis L.

Each such tension rod or stud bolt 19 extends with a slight clearance through an opening 20 in the side wall 14 and has one end portion screwed into a threaded blind hole 17B in the blade flange 17. The openings 20 are evenly distributed along the above-mentioned imaginary cylindrical surface D containing the axes of the stud bolts 19.

Figure 4:
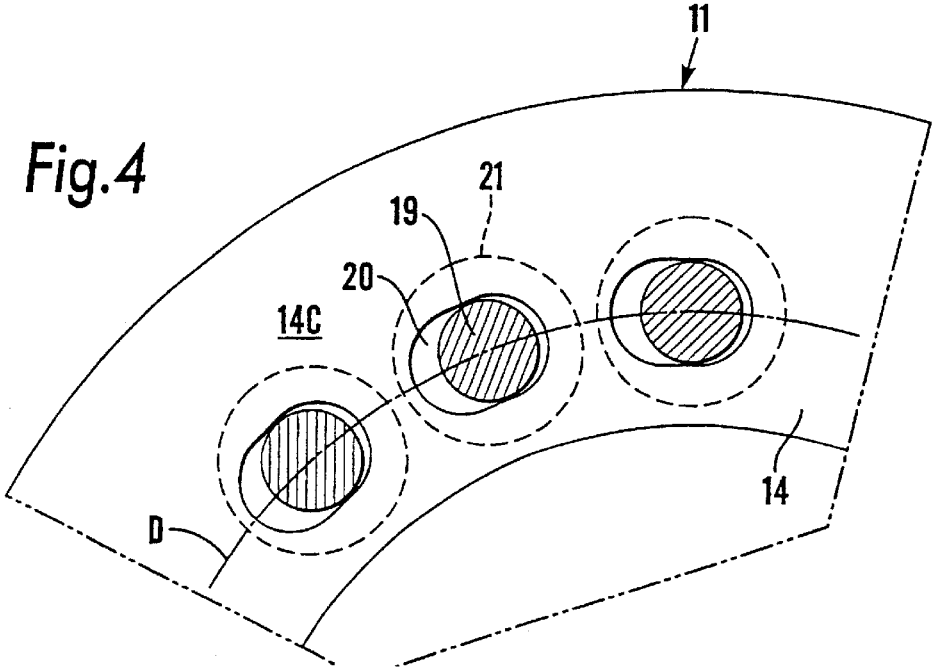
FIG. 4 shows a portion of the hub body as viewed from line IV—IV in FIG. 3.

As shown in FIG. 4, the openings 20 are elongate in the circumferential direction to admit of a slight rotational movement of the propeller blade 16 about the axis L and thereby admit of a stepless (continuous) variation of the pitch angle $\alpha$ of the propeller blade in an angular range of adjustment of a few degrees.

The other end portion of the stud bolt 19 extends inwardly beyond the inner side of the side wall 14 and has screwed onto it a component 21 which is here termed tensioning nut. The tensioning nut 21 serves to clamp the propeller blade flange 17 against the bearing surface 14C with a great force. It is of the type ("torquenut") marketed by the U.S. company Superbolt, Carnegie, Pa., USA, under the trade mark SUPERBOLT®.

Tension nut 21 comprises a flange member 22 in the shape of a generally circular cylindrical nut body with an internal thread mating with the external thread of the stud bolt 19. The flange member 22 is provided with a number of, sixteen in the illustrated embodiment, recesses in the shape of axial threaded bores 23 extending through the flange member and evenly spaced apart circumferentially. Into each such recess a tensioning member in the shape of a tensioning screw 24 having a head 25 is screwed from the outer side, i.e. the side of the flange member 22 which faces away from the inner side of the hub body wall 14. The tensioning screw 24 is of such length that when it is fully screwed into the recess, its tip protrudes from the inner side of the flange member 22, i.e. the side facing the hub body wall 14.

Associated with the tensioning nut 22 is a metal washer 26. This washer, which has a sliding fit to the stud bolt 19, is very hard at least on the side facing the flange member 22 so that it can withstand the high surface pressure produced by the tensioning screws 24.

In order that the washer 26 may not be excessively deformed at the portions thereof which bridge the open areas of the opening 20, i.e. the areas which are not occupied by the stud bolt 19 (see FIG. 4), it should have a certain minimum thickness. If desired, the illustrated washer 26 may be supplemented by an additional washer (not shown), suitably the very hard but relatively thin washer forming a standard part of the SUPERBOLT® tensioning nut and placed adjacent the flange member 22. In that case, the washer 26 may be somewhat thinner and less hard than in the case where it is the only washer. Suitably, the thickness of the washer 26 or, in the case where an additional washer is used, the combined thickness of the two washers, is at least 0.3 times the radial width of the opening 20.

When a propeller blade 16 is to be mounted it is placed with the inner or bottom side 17C of the blade flange 17 resting on the bearing surface 14C and with the holes 17B in the blade flange in register with the elongate openings 20 in the hub body wall 14. Then the stud bolts 19 are screwed into the blade flange holes 17B from within the cavity 11A of the hub body 11, the washers 26 are slid over the stud bolts 19 and the tensioning nuts 21 are screwed onto the protruding ends of the stud bolts. After the propeller blade has been turned to the desired position, the tensioning nuts 21 are tightened until there is no gap between the blade flange 17 and the hub body wall 14 or between the latter and the washer-tensioning nut assembly. This tightening can be carried out without it being necessary to apply a very great torque to the tensioning nuts 21. If the tensioning screws 24 are already inserted in the flange member 22, they should not be screwed so far that their tips protrude from the inner side of the flange member.

Then the tensioning screws 24 of each tensioning nut 21 are tightened to take support on the hub body wall 14 through the intermediary of the washer 26 and lift the flange member 22 from the washer so that the associated stud bolt 19 will be tensioned. Because of the large number of tensioning screws 24 of each tensioning nut 21, the tensile load on the stud bolts 19 can be applied with a moderate effort and still be sufficient for the propeller blade to be adequately locked in the selected position solely by the friction between the blade flange 17 and the bearing surface 14C. Accordingly, the tightening can be accomplished with the aid of a small power wrench from within the cavity 11A of the hub body 11. Finally the cover plate 15 is attached.

If the setting of the propeller blades 16 needs to be changed, the cover plate 15 is removed so that the tensioning screws 24 and thus the tensioning nuts 21 can be loosened to admit of turning of the propeller blades to the desired new position, whereupon the tensioning nuts and the tensioning screws are retightened.

If the propeller 10 will likely have to operate under very severe conditions, such as in ice, so that the propeller blades will be subject to severe loads, additional locking against undesired turning of the propeller blades can be achieved by applying a friction-enhancing material to the bearing surface 14C of the hub body and/or the associated inner side 17C of the blade flange 17, e.g. by spraying a layer of chromium oxide or tungsten carbide onto one of the surfaces or both.

What is claimed is:

1. A marine propeller comprising a hollow hub body (11), a plurality of propeller blades (16) distributed about the hub body (11) and detachably secured to it in engagement with an external bearing surface (14C) on a wall of the hub body, a plurality of fastening devices (19,21) for each propeller blade (16), each fastening device including a tension rod (19) which extends from the cavity (11A) of the hub body (11) through openings (20) in the wall of the hub body and is anchored in the hub body, and a flange member (22) mounted on the tension rod and supported against the side of the hub body wall (14) facing the cavity (11A) of the hub body, characterised in that the flange member (22) of each fastening device (19,22) has a plurality of recesses (23) distributed about the tension rod (19) and tensioning members (24) received in the recesses, the tensioning members (24) being extendable from the flange member (22) towards the hub body wall (14) to apply tension to the tension rod (19).

2. A marine propeller comprising a hollow hub body (11), a plurality of propeller blades (16) distributed about the hub body (11) and detachably secured to it in engagement with an external bearing surface (14C) on a wall of the hub body, a plurality of fastening devices (19,21) for each propeller blade (16), each fastening device including a tension rod (19) which extends from the cavity (11A) of the hub body (11) through openings (20) in the wall of the hub body and is anchored in the hub body, and a flange member (22) mounted on the tension rod and supported against the side of the hub body wall (14) facing the cavity (11A) of the hub body), said openings (20) in the wall (14) of the hub body (11) being elongate and the propeller blades (16) being turnable on the bearing surface (14C) for adjustment of the blade pitch angle ($\alpha$) in an angular range determined by the elongate openings (20) and lockable in a selected position of adjustment within said range by means of the fastening devices (19, 21).

characterised in that the flange member (22) of each fastening device (19,22) has a plurality of recesses (23) distributed about the tension rod (19) and tensioning members (24) received in the recesses, the tensioning members (24) being extendable from the flange member (22) towards the hub body wall (14) to apply tension to the tension rod (19).

3. A marine propeller as claimed in claim 1 or 2 in which the tension rod (19) is connected to the propeller blade (16) by means of a thread connection.

4. A marine propeller as claimed in claim 1 or 2 in which the tension rod (19) is a stud bolt, one end of which is screwed into the propeller blade (16), and the flange member (22) is a nut screwed onto the other end portion of the stud bolt.

5. A marine propeller as claimed in claim 3, in which the flange member (22) and the tension rod (19) form an integral piece.

6. A marine propeller as claimed in claim 4 in which the flange (22) member is supported against the wall (14) of the hub body through the intermediary of at least one washer (26) of hard material.

7. A marine propeller as claimed in claim 6 in which the thickness of the washer (26), or the combined thickness of the washers, is at least 0.3 times the width of the opening (20).

8. A marine propeller as claimed in claim 1 or 2 in which the recesses (23) of the flange member are threaded axial bores extending through the flange member, and the tensioning members (24) are tensioning screws received in the recesses.

9. A marine propeller as claimed in claim 1 or 2 in which a frictionenhancing material, such as a layer of chromium oxide or tungsten carbide, is applied to at least one of the bearing surface (14C) of the hub body and the propeller blade surface (17C) seated against the bearing surface.

* * * * *